US006811105B2

(12) United States Patent
Kato et al.

(10) Patent No.: US 6,811,105 B2
(45) Date of Patent: Nov. 2, 2004

(54) FUEL INJECTION NOZZLE

(75) Inventors: Masaaki Kato, Kariya (JP); Kenji Date, Obu (JP)

(73) Assignee: Denso Corporation, Kariya (JP)

( * ) Notice: Subject to any disclaimer, the term of this patent is extended or adjusted under 35 U.S.C. 154(b) by 223 days.

(21) Appl. No.: 10/285,487

(22) Filed: Nov. 1, 2002

(65) Prior Publication Data

US 2003/0094517 A1 May 22, 2003

(30) Foreign Application Priority Data

Nov. 16, 2001 (JP) ..... 2001-351182
May 23, 2002 (JP) ..... 2002-149318

(51) Int. Cl.[7] ..... F02M 59/00; F02M 61/00; B05B 1/30

(52) U.S. Cl. ..... 239/533.2; 239/533.3; 239/585.1; 239/585.5; 239/88

(58) Field of Search ..... 239/533.2, 533.3, 239/533.7, 533.8, 533.9, 533.12, 585.1, 585.2, 585.3, 585.4, 585.5, 88–93; 251/127, 129.15, 129.21

(56) References Cited

U.S. PATENT DOCUMENTS 5,544,816 A * 8/1996 Nally et al. ..... 239/585.5
5,636,615 A * 6/1997 Shorey et al. ..... 123/506
5,921,475 A * 7/1999 DeVriese et al. ..... 239/585.4
5,996,911 A * 12/1999 Gesk et al. ..... 239/585.1

FOREIGN PATENT DOCUMENTS

JP 63-51154 4/1988
JP 5-321789 12/1993

* cited by examiner

*Primary Examiner*—Davis Hwu
(74) *Attorney, Agent, or Firm*—Nixon & Vanderhye P.C.

(57) ABSTRACT

In a fuel injection nozzle, a nozzle body is provided inside with a guide hole having a second guide portion (cylindrical hole) for slidably holding a guide shaft of a needle and a seat surface axially below the second guide portion, with first injection bores opened to the seat surface and with second injection bores opened to an inner circumference of the second portion. The needle is provided at an end thereof with a circular seat contact coming in contact with the seat surface axially above the first injection bores and inside the guide shaft with a fuel passage through which fuel is supplied to a position axially above the seat contact. With the construction mentioned above, as the second guide portion is formed axially above the sack chamber and inner diameter thereof is larger than that of the sack chamber, the second guide portion is more easily formed at lower cost.

12 Claims, 11 Drawing Sheets

FUEL INJECTION NOZZLE

CROSS REFERENCE TO RELATED APPLICATION

This application is based upon and claims the benefit of priority of Japanese Patent Applications No. 2001-351182 filed on Nov. 16, 2001 and No. 2002-149318 filed on May 23, 2002, the contents of which are incorporated herein by reference.

BACKGROUND OF THE INVENTION

1. Field of the Invention

The present invention relates to a fuel injection nozzle in which a needle slidably fitted to a guide hole of a nozzle body stepwise lifts for injecting fuel.

2. Description of the Prior Art

Conventionally, as disclosed in JP-U-63-51154, JP-A-5-321789 and so on, a fuel injection nozzle is known, in which stepwise lift of a needle causes injection bores arranged axially up and down to sequentially open for injecting fuel. A first conventional fuel injection nozzle disclosed in JP-U-63-51154 has first injection bores opened to a seat surface of a nozzle body and second injection bores opened to a sack chamber of the nozzle body. A seat contact of a needle controls to open and close the first injection bores and a shaft tip of the needle inserted into the sack chamber controls to open and close the second injection bores.

A second conventional fuel injection nozzle disclosed in JP-A-5-321789 has fist and second injection bores provided axially at given intervals in a sack chamber of a nozzle body and a shaft tip of the needle inserted in the sack chamber controls to open and close both of the first and second injection bores.

However, the first conventional injection nozzle has a drawback that it is very difficult and costly to precisely form the sack chamber to secure better sliding inner surface of the sack chamber that comes in contact with the shaft tip of the needle without fuel leakage, since the sack chamber is positioned at the deepest bottom of the nozzle body and sack diameter thereof is relatively small.

Further, when fuel is supplied to the second injection bores after the first injection bores have been opened, fuel flows at high speed along the sliding inner surface of the sack chamber so that the sliding inner surface tends to be worn out by foreign material contained in the fuel. Furthermore, as the sack chamber provided at a leading end of the nozzle body is exposed to high temperature combustion gas, hardness of the shaft tip of the needle is likely reduced so that the shaft tip is prone to wear. As a result, when the needle is at a position where the second injection bores are closed and only first injection bores are opened, fuel is likely to be injected into an engine combustion chamber from the second injection bores due to the fuel leakage along the sliding inner surface of the sack chamber that has been worn out, which results in increasing black smoke and hydrocarbon contained in exhausted combustion gas.

In the second conventional fuel injection nozzle, the sack diameter is relatively large since the first injection bores are positioned in the sack chamber and it is required to secure sufficient fuel flow passage area therein. Consequently, it is inevitable that seat diameter is relatively large and pressure receiving area of the needle on which fuel pressure acts tends to be relatively small, failing in securing sufficient valve opening force so that response characteristic of opening and closing the injection bores is poorer.

Further, it is very difficult and costly to precisely form the sliding inner surface of the sack chamber, similarly to the first conventional fuel injection nozzle.

SUMMARY OF THE INVENTION

An object of the present invention is to provide a fuel injection nozzle for injecting high pressure fuel in which a nozzle body member is easily manufactured to limit inadequate fuel leakage so that emissions such as black smoke and hydrocarbon are reduced.

To achieve the above object, in the fuel injection device, a nozzle body member is provided inside with a guide hole having a conical inner circumferential wall in a vicinity of an end thereof and a cylindrical inner circumferential wall axially above the conical inner circumferential wall, with at least a first injection bore whose one end is opened to the conical inner circumferential wall and whose another end is opened to outside, and on an axially above side of the first injection bore with at least a second injection bore whose one end is opened to one of the conical and cylindrical circumferential walls and whose another end is opened to outside. A needle member is inserted into the guide hole and the needle member is provided in a vicinity of an end thereof with a circular seat contact coming in contact with the conical inner circumferential wall, on an axially above side of the seat contact with a guide shaft whose outer diameter is larger than that of the circular seat contact and which is slidably fitted to the cylindrical circumferential wall, and with a fuel passage extending inside the guide shaft for introducing fuel to the first and second injection bores.

With the fuel injection nozzle mentioned above, when the needle member does not lift, the circular seat contact is in contact with the conical inner circumferential wall and the fuel passage does not communicate with both the first and second injection bores, when the needle member shows a first lift, the circular seat contact moves in a direction of leaving the conical inner circumferential wall and the fuel passage communicates with the first injection bore through a clearance between the circular seat contact and the conical inner circumferential wall but the guide shaft interrupts communication between the fuel passage and the second injection bore, and, when the needle member shows a second lift, the circular seat contact further moves in a direction of leaving the conical inner circumferential wall and, in addition to the communication between the fuel passage and the first injection bore, the guide shaft allows the communication between the fuel passage and second injection bore.

According to the fuel injection nozzle mentioned above, as the cylindrical inner circumferential wall is formed axially above the position where the sack chamber of the conventional fuel injection nozzle is provided and inner diameter of the cylindrical inner circumferential wall is larger than that of the sack chamber, the cylindrical inner circumferential wall is more easily formed at lower cost, compared with the conventional fuel injection nozzle in which the tip of the guide shaft is inserted into the sack chamber.

It is preferable that the needle member is provided axially above the guide shaft with an upper small diameter portion and axially below the guide shaft with a lower small diameter portion and the fuel passage is a plurality of through-holes each axially penetrating from an upper end of the guide shaft radially outside the upper small diameter portion to a lower end thereof radially outside the lower small diameter portion and axially above the circular seat contact. Further, the one end of the first injection bore is arranged axially below a position where the circular seat contact comes in contact with the conical inner circumferential wall, and outer circumference of the guide shaft serves, when the needle member does not lift or shows the first lift, to close the one end of the second injection bore and, when the needle member shows the second lift, to open the one end of the second injection bore.

Preferably, the guide shaft is provided at the lower end thereof radially outside the lower small diameter portion with a guide shaft ring groove to which the through-holes are opened so that the lower end circumference of the guide shaft radially outside the guide shaft ring groove constitutes a thin thickness wall. Accordingly, when the needle member does not lift or shows the first lift and the guide shaft ring groove is filled with high pressure fuel, the thin thickness wall of the lower end of the guide shaft expands radially outward so that the guide shaft fluid-tightly closes the one end of the second injection bore and suppresses fuel leakage from the second injection bore.

As an alternative, the fuel passage may has a lateral hole radially extending in the guide shaft at a position axially above an upper end of the cylindrical inner circumferential wall and a vertical hole whose one end is opened to the lateral hole, which axially extends through a center of the guide shaft and whose another end is opened to a lower end of the needle member axially below the circular seat contact. Further, the end of the first injection bore is arranged axially above a position where the circular seat contact comes in contact with the conical inner circumferential wall, and outer circumference of the guide shaft serves, when the needle member does not lift or shows the first lift, to close the one end of the second injection bore and, when the needle member shows the second lift, to open the one end of the second injection bore.

Further, it is preferable that the nozzle body member comprises a nozzle body and a ring shaped guide member whose outer circumference is press fitted into an inner circumference of the nozzle body. The ring shaped guide member has the cylindrical inner circumferential wall from which the second injection bore extends via both insides of the ring shaped guide member and the nozzle body to outside of the nozzle body. Since the cylindrical inner circumferential wall is formed in the ring shaped guide member that is a body separated from the nozzle body, the cylindrical inner circumferential wall can be more easily and precisely manufactured.

Moreover, it is preferable that both of the nozzle body and the ring shaped guide member have positioning portions with reference to which relative circumferential position between the nozzle body and the ring shaped guide member is defined. The respective positioning portions serve to secure an accurate relative circumferential position between the nozzle body and the ring shaped guide member, when the ring shaped guide member is formed separately from and, then, is press fitted into the nozzle body.

Furthermore, as an alternative, the needle member may have an outer needle provided inside with a cylindrical through-hole and in a vicinity of an end thereof with another circular seat contact coming in contact with the conical inner circumferential wall, and an inner needle slidably fitted to the cylindrical through-hole. The outer needle constitutes the guide shaft and the inner needle has the circular seat contact and the fuel passage. With this construction, when the needle member does not lift, both the circular and another circular seat contacts are in contact with the conical inner circumferential wall, when the needle member shows the first lift, only the inner needle moves and the outer needle does not move, and, when the needle member shows the second lift, the outer needle moves together with the inner needle.

Preferably, the fuel passage has a lateral hole radially extending in the inner needle at a position axially above an upper end of the outer needle and a vertical hole whose one end is opened to the lateral hole, which axially extends through a center of the inner needle and whose another end is opened to a lower end of the inner needle axially below the circular seat contact. Further, the one end of the first injection bore is arranged axially above a position where the circular seat contact comes in contact with the conical inner circumferential wall and axially below a position where the another circular seat contact comes in contact with the conical inner circumferential wall, the one end of the second injection bore is arranged at the conical inner circumferential wall axially above the position where the another circular seat contact comes in contact with the conical inner circumferential wall, and, when the needle member shows the first lift, the fuel passage communicates only with the first injection bore through the clearance between the circular seat contact and the conical inner circumferential wall and, when the needle member shows the second lift, the fuel passage communicates with the second injection bore through a clearance between the another circular seat contact and the conical inner circumferential wall.

Preferably, the inner and outer needles are provided with lift force transmitting means through which a lift force is transmitted from the inner needle to the outer needle at least when the needle member shows the second lift.

Further, it is preferable that at least one of the outer circumference of the guide shaft and the cylindrical inner circumferential wall is provided axially above the second injection bore with a ring shaped collection groove and the nozzle body member is provided with a collection passage whose one end communicates with the collection groove and whose another end communicates with a low pressure source, whereby the high pressure fuel entering a clearance between the outer circumference of the guide shaft and the cylindrical inner circumferential wall is returned through the collection groove and the collection passage to the low pressure source.

The collection groove serves not only to promote fuel lubrication in the clearance between the outer circumference of the guide shaft and the cylindrical inner circumferential wall is promoted but also to suppress fuel leakage through the second injection bore when the needle member does not lift or shows the first lift.

In case of the fuel injection nozzle having the inner and outer needles mentioned above, it is preferable that the outer needle is further provided with a radial through-hole whose one end communicates with the ring shaped collection groove when the needle member does not lift and the inner needle is provided on outer circumference thereof with a ring groove coming in communication with another end of the radial through-hole when the needle member shows the first lift. With the construction mentioned above, the high pressure fuel entering a clearance between the outer circumference of the outer needle and the cylindrical inner circumferential wall is returned through the collection groove and the collection passage to the low pressure source and the high pressure fuel entering a clearance between an outer circumference of the inner needle and an inner circumference of the outer needle is returned through the ring groove, the radial through-hole, the collection groove and the collection passage to the low pressure source.

Since the inner needle has the ring groove, high pressure fuel entering the clearance between the inner and outer needles is stored in the ring groove when the needle member does not lift so that not only fuel lubrication in the clearance between the inner and outer needles is promoted, but also fuel leakage through the first injection bore is suppressed.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DESCRIPTION OF THE PREFERRED EMBODIMENTS

Preferred embodiments of the present invention are described with reference to drawings.

(First Embodiment)

Figure 1:
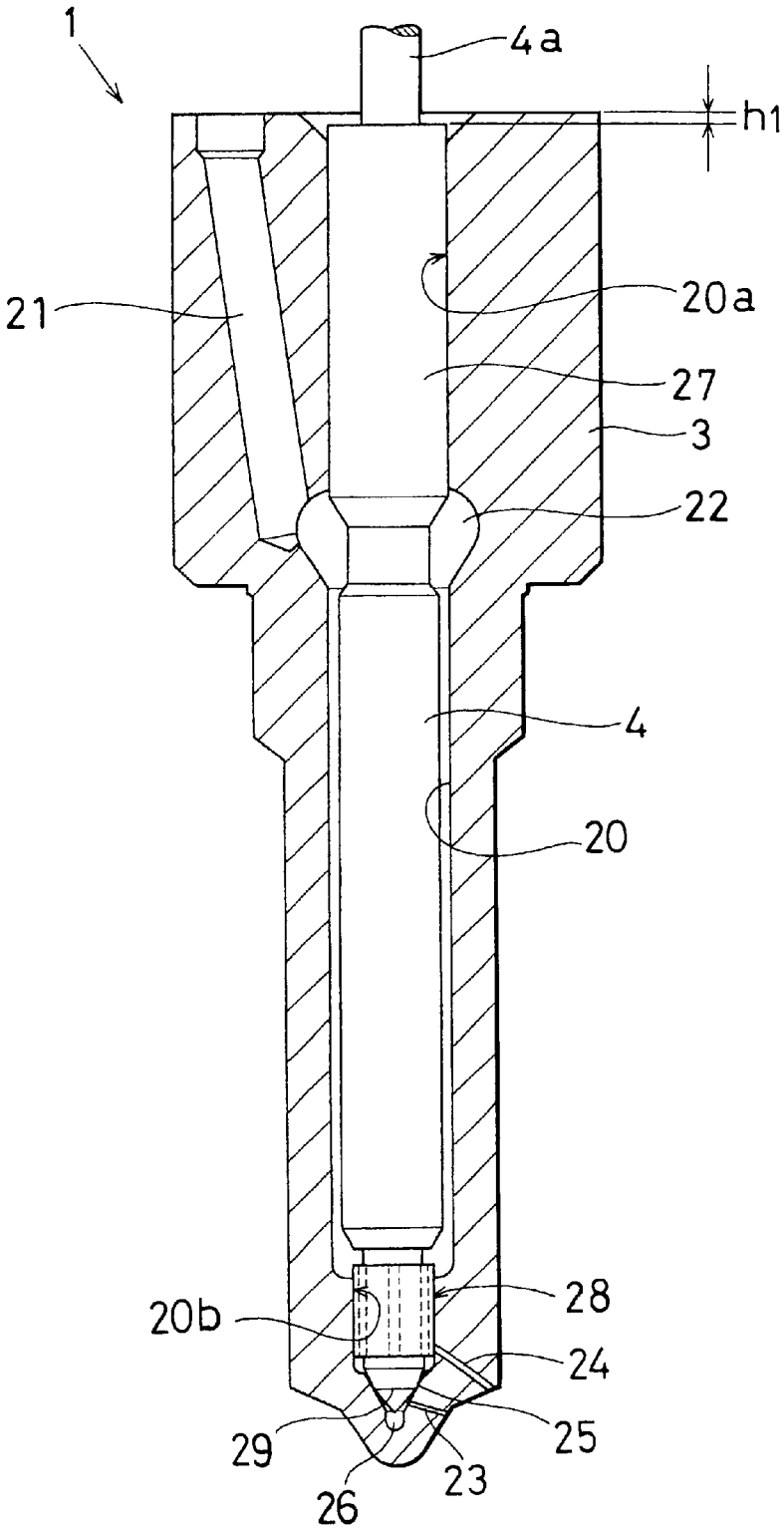
FIG. 1 is a cross sectional entire view of a fuel injection nozzle according to a first embodiment of the present invention.
Figure 2:
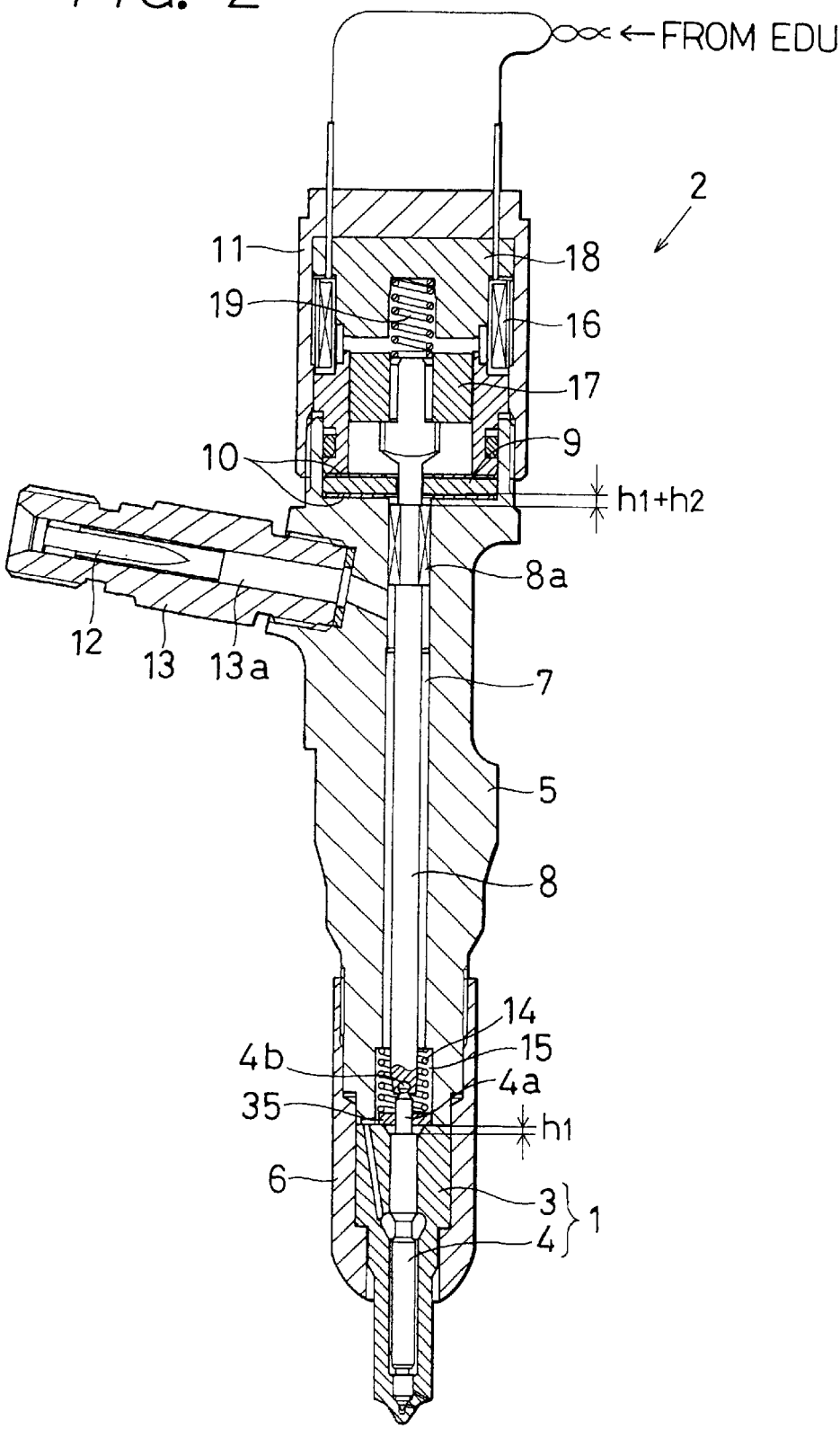
FIG. 2 is a cross sectional view of an injector incorporating the fuel injection nozzle of FIG. 1.
Figure 3:
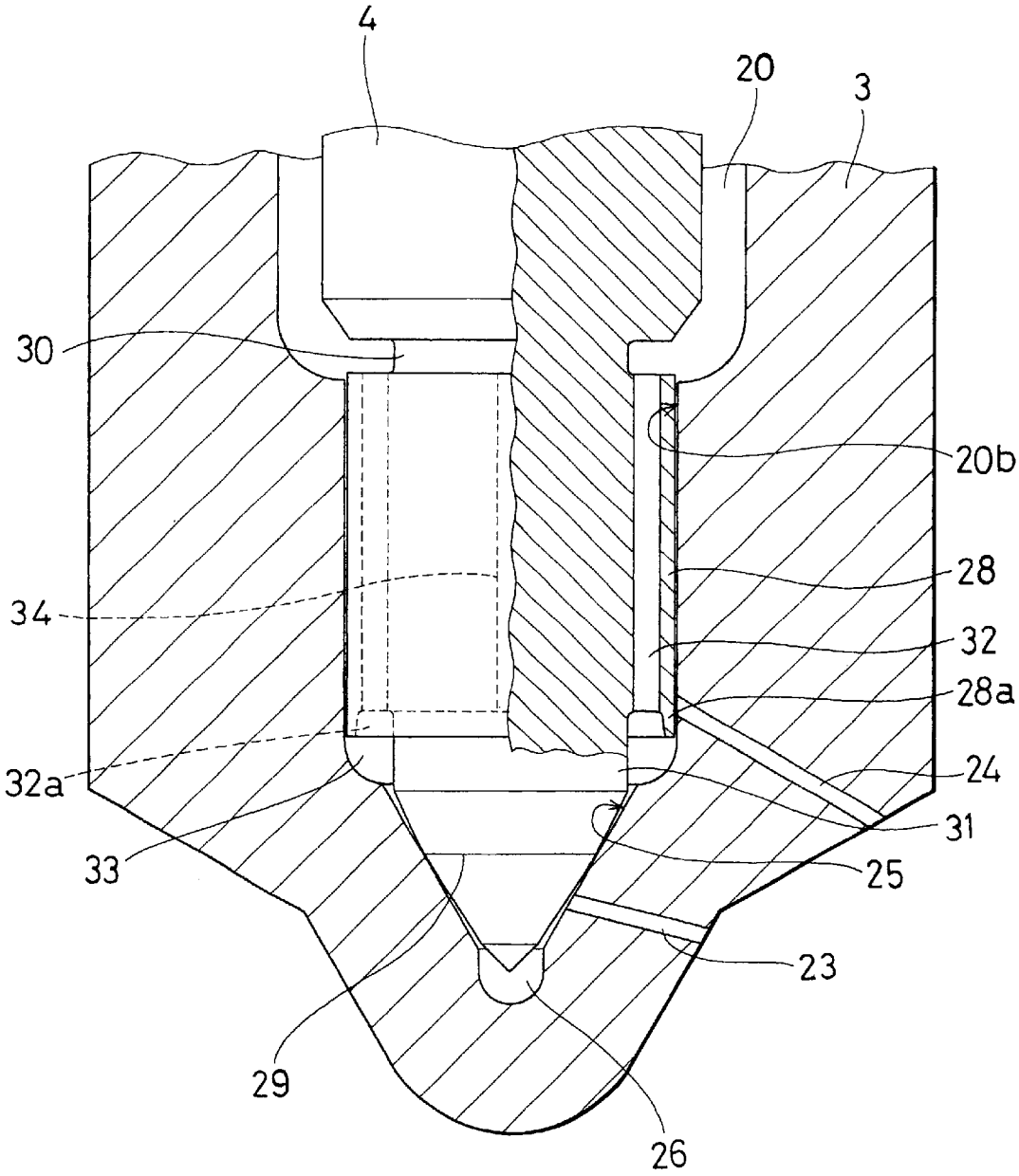
FIG. 3 is a partly enlarged cross sectional view of the fuel injection nozzle of FIG. 1.

FIG. 1 shows a cross sectional entire view of a fuel injection nozzle according to a first embodiment. FIG. 2 shows a cross sectional entire view of an injector incorporating the fuel injection nozzle of FIG. 1. FIG. 3 shows an enlarged cross sectional view of an end portion of the fuel injection nozzle of FIG. 1.

A fuel injection nozzle 1 (hereinafter called a nozzle 1) according to the first embodiment is applicable typically to an injector 2 for diesel engines and, as shown in FIG. 2, is composed of a nozzle body (nozzle body member) 3 and a needle (needle member) 4 accommodated in the nozzle body 3. The nozzle 1 is fixed to a lower end of an injector body 5 by a retaining nut 6.

In the injector 2, a piston 8 is slidably fitted into a through-hole 7 extending to axially pass through the injector body 5. An electromagnetic actuator is fixed via a piece of plate 9 and two pieces of shims 10 to an upper end of the injector body 5 by a nut 11.

The piston 8 is provided at an upper end thereof with a polygon shaped cut portion 8*a*. Space is provided between an upper end of the cutting portion 8*a* and the plate 9 to set a maximum lift amount (h1+h2) of the needle 4.

A fuel connector 13,in which a fuel filter 12 is housed, is attached to the injector body 5. High pressure fuel is supplied to the fuel connector 13 from a common rail (not shown). The fuel connector 13 is provided inside with a high pressure passage 13*a* communicating with the through-hole 7 so that high pressure fuel filtered by the fuel filter 12 is supplied to the through-hole 7 via the high pressure passage 13*a*.

The through-hole 7 is provided at a lower end thereof with a spring chamber 15 in which a second spring 14 is accommodated. The spring chamber 15 is used as a part of a fuel passage.

The electromagnetic actuator is composed of a coil 16 to which control current is applied via a drive circuit (EDU) from an electric control device (ECU), an armature 17 connected to and movable together with the piston 8, a core 18 axially opposed to the armature 17 with air gap therebetween and a first spring 19 urging the armature 17 downward in FIG. 2. Upon energizing the coil 16, the armature 17 is attracted upward so that the piston 8 is driven.

The air gap between the armature 17 and the core 18 is set to be slightly larger than the maximum lift amount (h1+h2) of the needle 4.

The nozzle body 3 is provided with a guide hole 20 into which the needle 4 is inserted, a fuel passage 21 and fuel injection bores (first injection bores 23 and second injection bores 24).

Upper and lower ends of the guide hole 20 have first and second guide portions (cylindrical holes) 20*a* and 20*b* which support slidably the needle 4, respectively. A conical shaped seat surface 25 is provided beneath the lower end of the second guide portion 20*b* and a sack chamber 26 is provided at a tip of the seat surface 25. Inner diameter of the second guide portion 20*b* is smaller than that of the first guide portion 20*a*.

A fuel sump 22, whose diameter is partly expanded on a way of the guide hole 20, communicates with the spring chamber 15 through a fuel passage 21(refer to FIG. 2) for introducing high pressure fuel from the spring chamber 15 to the fuel sump 22.

The fuel injection bores are composed of the first injection bores 23 opened to the seat surface 25 and the second injection bores 24 opened to a cylindrical inner circumferential surface of the second guide portion 20*b*. The respective first and second injection bores 23 and 24 are arranged circumferentially at regular intervals or irregular intervals in consideration of relationship between shape of an engine combustion chamber and intake air flow.

Figure 4:
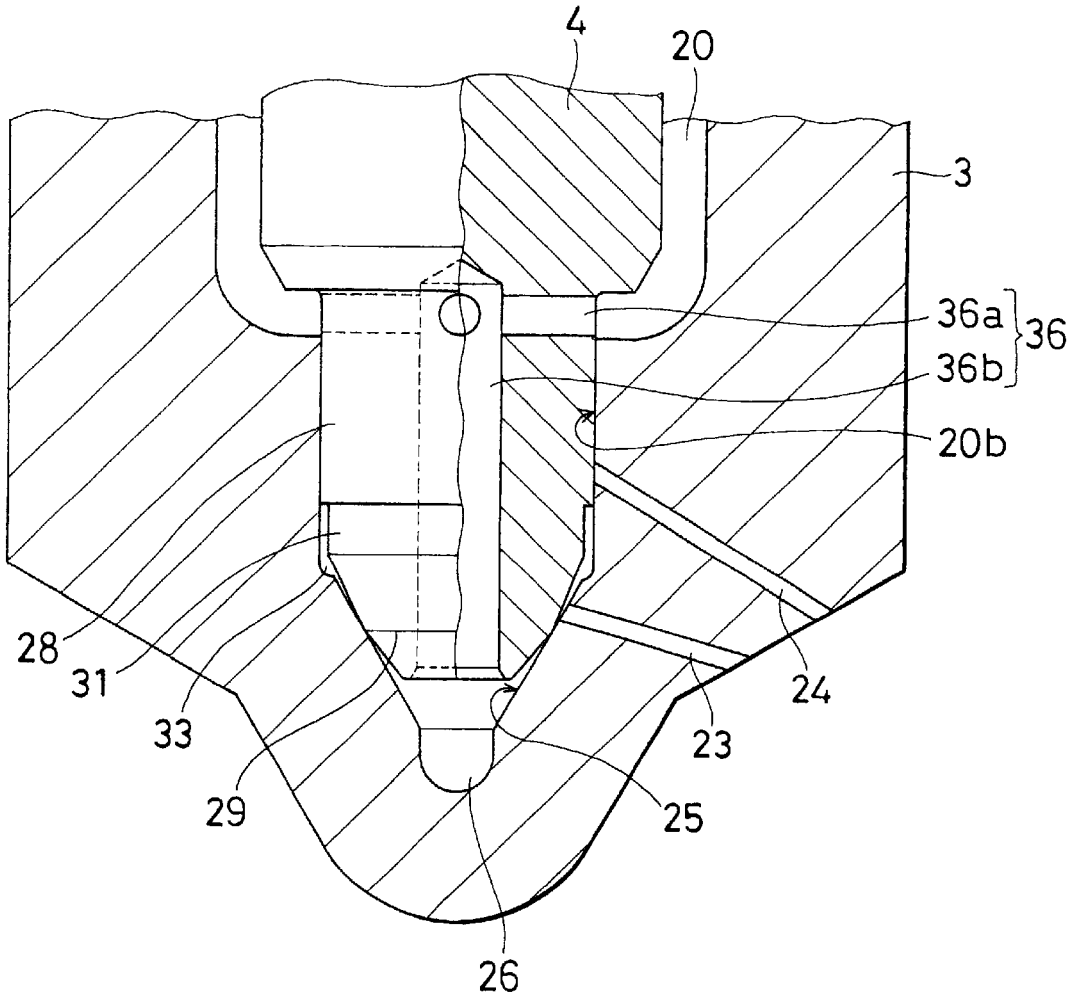
FIG. 4 is a partly enlarged cross sectional view of a fuel injection nozzle according to a second embodiment.

The needle 4 is provided at an upper end thereof with a first guide shaft 27 slidably supported by the first guide portion 20*a* and at a lower end thereof with a second guide shaft 28 sidably supported by the second guide portion 20*b*. As shown in FIG. 4, the needle 4 is provided at a lower end thereof with an upper conical surface and a lower conical surface whose conical angle is larger than that of the upper conical surface. A boundary line between the upper and lower conical surfaces constitutes a seat contact 29 to be seated on the seat surface 25 at a valve closing time.

The needle 4 is provided on upper and lower sides of the second guide shaft 28, respectively, with an upper side small diameter portion 30 and a lower side small diameter portion 31 whose each diameter is smaller than that of the second guide shaft 28. The needle 4 is further provided radially outside the upper and lower small diameter portions 30 and 31 with through-holes 32 penetrating axially from an upper end surface of the second guide shaft 28 to a lower end surface thereof. The through-holes 32 are fuel passages for delivering fuel from an upstream side of the second guide shaft 28 to a downstream side of the second guide shaft 28 (an oil sump 33 formed at outer circumference of the lower small diameter portion 31). The through-holes 32 are formed typically at four positions of the second guide shaft 28 excluding pillar portions 34 thereof and being spaced circumferentially. Each cross section of the through-holes 32 perpendicular to an axis of the second guide shaft 28 is formed in circular shape. The second guide shaft 28 is provided at the lower end with a ring shaped groove 32*a* to which each end of the through-holes 32 on a side of the lower small diameter portion 31 is opened so that a thin thickness circumferential wall 28*a* of the second guide shaft 28 is formed around the ring shaped groove 32*a*.

The seat contact 29 controls to open and close the first injection bores 23 and the second guide shaft 28 controls to open and close the second injection bores 24. That is, the first injection bores 23 are opened on a downstream side of the seat surface 25 with respect to a position where the seat contact 29 is seated on the seat surface 25 at a valve closing time.

As shown in FIG. 3, the second injection bores 24 are arranged at positions where openings of the second injection bores 24 are closed by the thin thickness circumferential wall 28*a* at a valve closing time. The thin thickness circumferential wall 28*a* is resiliently deformable and expanded radially outward, when the thin thickness circumferential wall 28*a* receives fuel pressure, so that a clearance between the second guide shaft 28 and the second guide portion 20 is fluid-tightly blocked.

As shown in FIG. 2, the needle 4 has a pole shaped projection 4*a* projecting upward from the first guide shaft 27. A spherical portion 4*b* provided at an upper end of the pole shaped projection 4*a* is rotatably fitted to a spherical recess provided at a lower end of the piston 8 so that the needle 4 is connected to and movable up and down together with the piston 8. A space is provided between an upper end of the first guide shaft 27 and a plate 35 disposed in the spring room 15 to set a first lift amount (h1) of the needle 4 in a state that the seat contact 29 is seated on the seat surface 25.

An operation of the nozzle 1 is described below.

Fuel supplied to the injector 2 from the common rail is introduced after being filtered by the fuel filter 12 of the fuel connector 13 into the through-hole 7 via the high pressure passage 13*a* and, then, supplied to the nozzle 1 via the spring chamber 15.

In the nozzle 1, the fuel is supplied to the guide hole 20 (ring shaped space formed around the needle 4) from the fuel passage 21 of the nozzle body 3 and the fuel sump 22 and, then, to the oil sump 33 via the through-holes 32 of the second guide shaft 28 so that space between the oil sump 33 and the seat contact 29 in contact with the seat surface 25 is filled with the fuel.

At this time, the needle 4 receives a force corresponding to fuel pressure multiplied by a cross sectional area of the seat contact 29. This force urges the needle 4 toward the seat surface 25 of the nozzle body 3. In addition to this force, preset load of the first spring 19 incorporated in the electromagnetic actuator biases the needle 4 so that the needle 4 is pushed downward to keep a valve closing state.

When first value of current is applied to the coil 16, magnetic force is induced between the core 18 and the armature 17 so that the armature 17 is attracted toward the core 18 with attracting force which exceeds a sum of forces due to the preset load of the spring 19 and the fuel pressure urging the needle 4 in a valve closing direction. Accordingly, the armature 17 moves upward together with the piston 8 and the needle 4.

The first value of current does not induce the magnetic force which is sufficient enough to attract the armature 17 against preset load of the second spring 14 after the upper end of the needle 4 comes in contact with the plate 35 so that the needle 4 rests after having moved upward by the first lift amount (h1). As a result, the seat contact 29 of the needle 4 leaves the seat surface 25 so that the first injection bores 23 are opened to inject high pressure fuel therefrom. At this time, that is, in a first lift state, an injection rate as injection characteristic of the fuel injection nozzle 1 is low, since the outer circumference of the second guide shaft 28 (the thin thickness circumferential wall 28*a* closes the second injection bores 24. When the diesel engine is under conditions of low/middle speed and low/middle load, the first lift state is applicable for realizing an optimum operation of the engine in which atomized combustible mixture of fuel and air is stratified to improve fuel consumption, exhaust emission and noises.

When second value of current is applied to the coil 16, the force of attracting the armature 17 exceeds the preset load of the second spring 14 so that the needle 4 further moves upward until the upper end of the piston 8 comes in contact with the plate 9 to achieve the maximum lift amount (h1+h2). At this time, that is, in second lift state, the injection rate as injection characteristic of the fuel injection nozzle 1 is high, since the second guide shaft 28 is at a position where the second injection bores are opened and high pressure fuel is injected from not only from the first injection bores 23 but also from the second injection bores 24. The second lift state is applicable, when the engine is under conditions of high load, for realizing widely diffused atomization whose destination distance is longer to secure optimum combustion.

When current supply to the coil 16 stops, the electromagnetic force for attracting the armature 17 extinguishes so that all of the armature 17, the piston 8 and the needle 4 are pushed down by the biasing forces of the first and second springs 19 and 14.

When the needle 4 is pushed down to a position corresponding to the first lift state, the biasing force of the second spring 14 does not act on the needle 4 and only the biasing force of the first spring 19 acts in a direction of pushing down the armature 17. Accordingly, the seat contact 29 of the needle 4 comes in contact with and is pressed against the seat surface 25 due to the biasing force of the first spring 19.

Though the first embodiment mentioned above is described as an example in which the nozzle 1 is controlled to achieve the second lift state (maximum lift state) successively after the first lift state is achieved, the nozzle 1 may be controlled to achieve only the first lift state or to achieve only the second lift state by skipping the first lift state.

In the nozzle 1 mentioned above, the second guide portion 20*b*, whose inner diameter is larger than the seat diameter, supports the second guide shaft 28 of the needle 4. That is, the second guide portion 20 is arranged axially above the seat position where the seat contact 29 of the needle 4 comes in contact with the seat surface 25. Since the second guide portion 20*b* is positioned axially above the sack chamber 26 and the inner diameter of the guide portion 20*b* is larger than that of the sack chamber 26, the second guide portion 20 can be easily and precisely manufactured at lower cost, compared with the conventional nozzle in which the shaft end of the needle is inserted into and supported by the sack chamber.

Further, according to the present embodiment, the sack chamber 26 is provided as a relief for manufacturing the seat surface 25 and also as a relief for preventing the leading end of the needle 4 from being interfered with the nozzle body 3 at the valve closing time. Therefore, it is not necessary to manufacture precisely the sack chamber 26 since the sack chamber 26 is not used as the sliding portion that is required in the conventional sack chamber.

The needle 4 according to the present embodiment is provided inside the second guide shaft 28 with the through-holes 32 serving as the fuel passages, and at the lower end of the second guide shaft 28 with the ring shaped groove 32 and the thin thickness circumferential wall 28*a*. Pressure of fuel with which the through-holes 32 are filled serves to deform the thin thickness circumferential wall 28*a* radially outward so that the clearance between the outer circumference of the second guide shaft 28 and the inner circumference of the second guide portion 20*b* is blocked to completely close the second injection bores 24 opened to the second guide portion 20*b*, resulting in preventing fuel leakage from the second injection bores 24.

At the valve opening time when the needle 4 moves upward, the thin thickness circumferential wall 28*a* is less deformed since fuel pressure in the oil sump 33 is lower so that sliding motion between the second guide portion 20*b* and the second guide shaft 28*a* is smoother. Further, at the valve closing time when the needle 4 moves downward, the sliding motion between the second guide portion 20*b* and the second guide shaft 28*a* is still smoother and does not harm the valve closing operation since the fuel is injected from the first and second injection bores 23 and 24, flow speed of fuel passing through the through-holes 32 is higher and pressure of the fuel is lower.

(Second Embodiment)

FIG. 4 shows an enlarged cross sectional view of an end portion of a nozzle according to a second embodiment.

In a nozzle 1 according to the second embodiment, a diameter of the second guide shaft 28 is smaller than that of the first embodiment. The second guide shaft 28 is provided with a fuel passage 36 passing through an inside thereof and communicating with the sack chamber 26, instead of the through-hole 32 of the first embodiment.

As shown in FIG. 4, an outer diameter of the second guide shaft 28 of the needle 4 is slightly larger than that of the lower side small diameter portion 31.

The fuel passage 36 is composed of a plurality of lateral holes 36*a* circumferentially spaced and radially extending in the second guide shaft 28 at a position axially above an upper end of the second guide portion 20*b* in a valve closing state and a vertical hole 36*b* whose one end is opened to the lateral holes 36*a*, which axially extends through a center of the second guide shaft 28 and whose another end is opened to a lower end of the needle 4 axially below the seat contact 29.

With the construction mentioned above, since fuel is supplied to the lower end of the needle 4 that is positioned axially below the seat contact 29, fuel pressure is not applied to the oil sump 33 in a valve closing state so that fuel leakage from the second injection bores 24 is suppressed in the valve closing state.

Further, as the outer diameter of the second guide shaft 28 is smaller, the second injection bores 24 can be formed at lower position of the nozzle body 3 so that the nozzle 1 less protrudes into the combustion chamber of the engine. Further, Even if the seat diameter is smaller, sufficient valve opening force can be secured.

Moreover, since fuel flows from the lateral holes 36*a* trough the vertical hole 36*b* and the sack chamber 26 to the seat contact 29, the axial end of the nozzle 1 is cooled down by the fuel so that strength deterioration of the nozzle 1 due to heat is prevented and the preheated fuel promotes fuel atomization.

(Third Embodiment)

Figure 5:
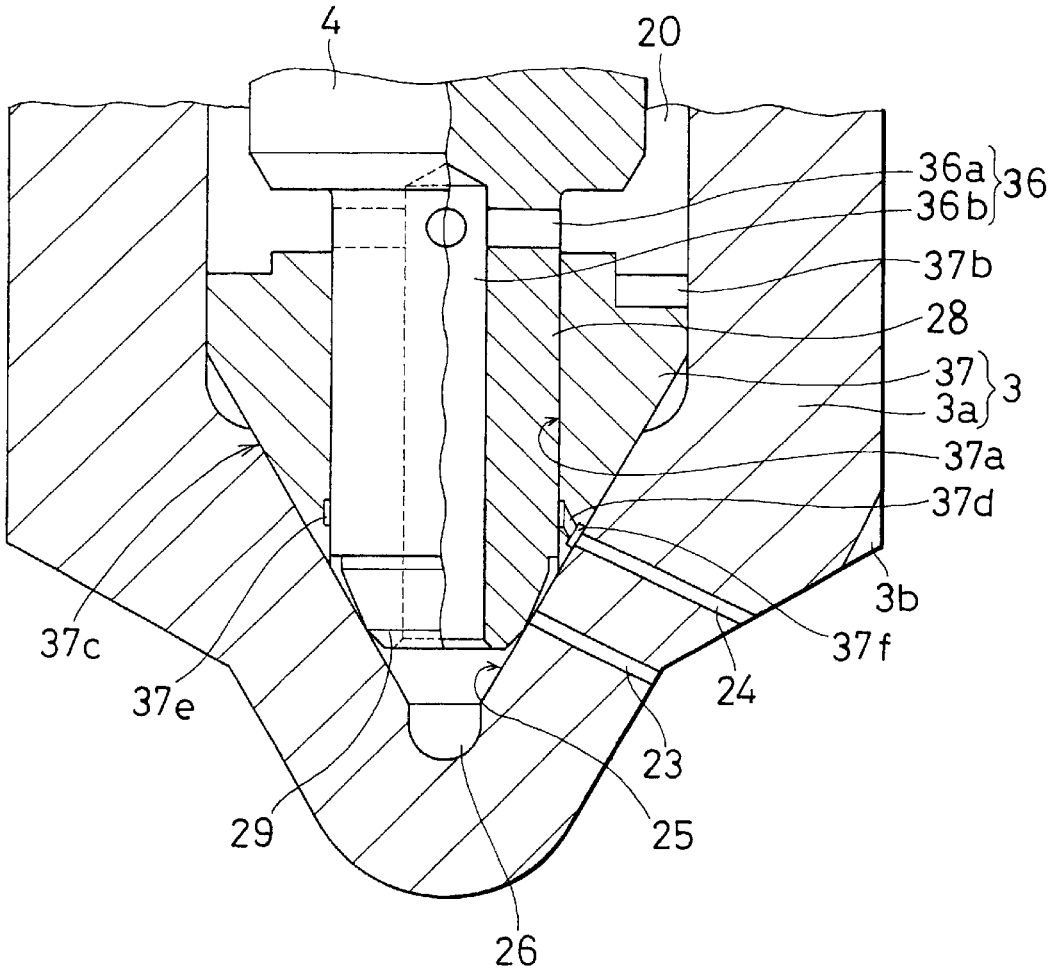
FIG. 5 is a partly enlarged cross sectional view of a fuel injection nozzle according to a third embodiment.

FIG. 5 shows an enlarged cross sectional view of an end portion of a nozzle according to a third embodiment.

In a nozzle 1 according to the third embodiment, a ring shaped guide member 37, which is provided separately from a nozzle body 3*a*, has a second guide portion 37*a* at inner circumference thereof and an outer circumference of the ring shaped guide member 37 is press fitted to the guide hole 20 of the nozzle body 3*a*. The ring shaped guide member 37 and the nozzle body 3*a* constitute the nozzle body member 3.

The nozzle body 3*a* and the ring shaped guide member 37 have positioning portions 3*b* and 37*b* with reference to which relative circumferential position between the nozzle body 3*a* and the ring shaped guide member 37 is defined.

The ring shaped guide member 37 is provided a conical surface 37 in intimate and fluid-tight contact with the seat surface 25 of the nozzle body 3*a* and with through-holes 37*d* each communicating with the second injection bore 24 formed in the nozzle body 3*a*. The through-hole 37*d* is a part of the second injection bore 24. The ring shaped guide member 37 may be provided on the inner circumference thereof (on the second guide portion 37*a*) with a ring groove 37*e* communicating with an inlet end of the through-hole 37*d* so that the ring groove 37*e* is opened and closed by the second guide shaft 28 and, further, on the outer circumference thereof with an enlarged portion 37*f* communicating with the second injection bore 24 formed in the nozzle body 3*a*.

Since the second guide portion 37*a* is not provided in the nozzle body 3*a* but provided in the ring shaped guide member 37 separately formed from the nozzle body 3*a*, the second guide portion 37*a*, which is a cylindrical inner circumferential wall for supporting the second guide shaft 28, can be easily and precisely manufactured.

Further, smaller inner diameter of the second guide portion 37 can be formed, since the ring shaped guide member 37 and the nozzle body 3*a* are separate bodies, so the outer diameter of the second guide shaft 28 is smaller than that of the second embodiment.

Moreover, the through-hole 37 can be formed at an angle different from that of the second injection bore 24 formed in the nozzle body 3*a*. The outlet end of the second injection bore 24 can be formed at a lower position of the nozzle body 3*a*, compared with that of the second embodiment. As a result, the nozzle 1 less protrudes into the combustion chamber of the engine, so strength deterioration of the nozzle body 3*a* due to heat is smaller.

Furthermore, the nozzle 1 according to the third embodiment can be formed by press fitting the ring shaped guide member 37 separately provided into the conventional nozzle body without newly designing the nozzle 1.

(Fourth Embodiment)

Figure 6:
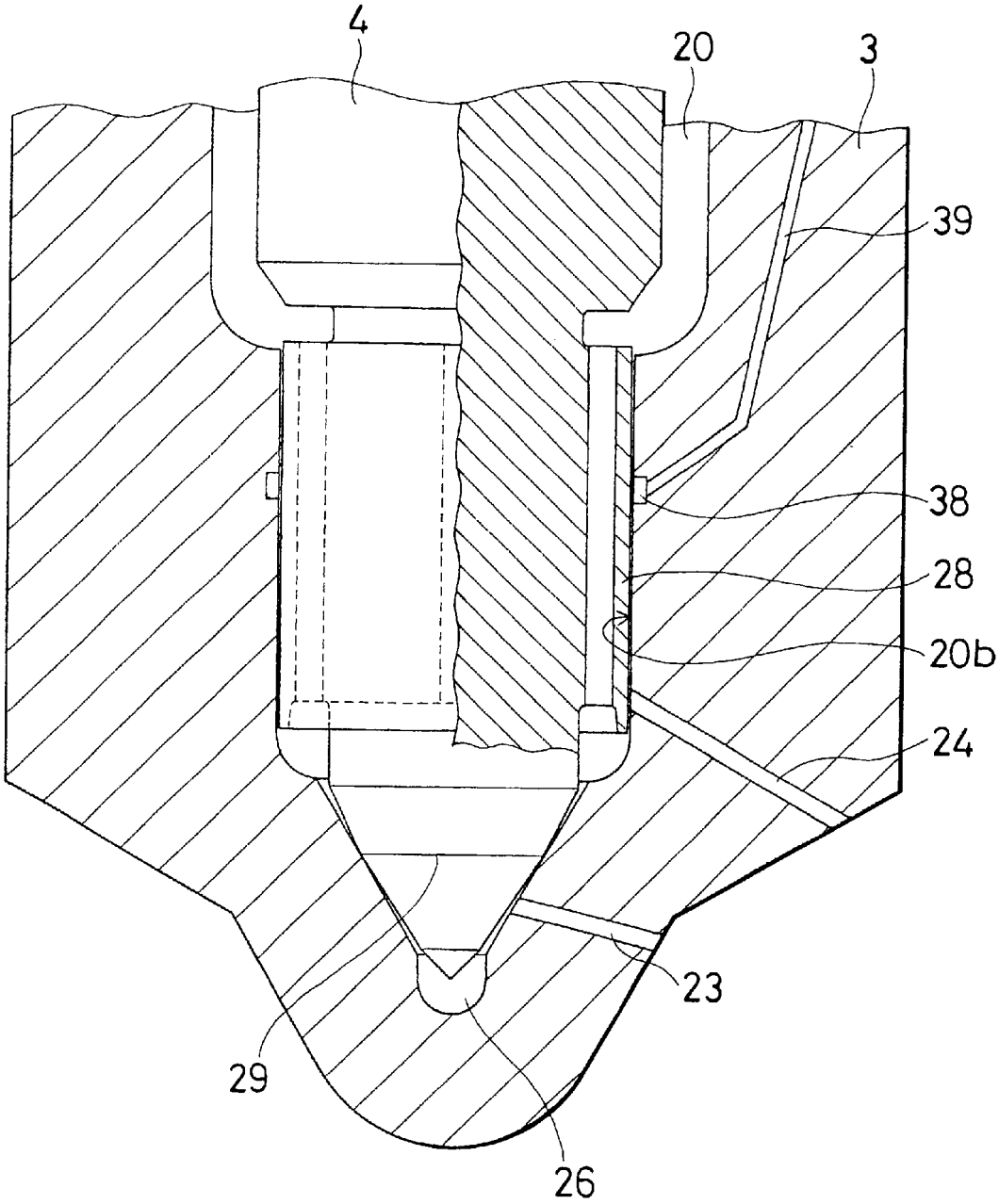
FIG. 6 is a partly enlarged cross sectional view of a fuel injection nozzle according to a fourth embodiment.

FIG. 6 shows an enlarged cross sectional view of an end portion of a nozzle according to a fourth embodiment.

In addition to the construction of the nozzle 1 according to the first embodiment, a nozzle 1 according to the fourth embodiment has fuel collection means for collecting fuel flowed into a sliding clearance between the second guide shaft 28 of the needle 4 and the second guide portion 20*b*.

The fuel collection means are composed of a collection groove 38 provided in the nozzle body 3 and a collection passage 39.

The collection groove 38 is a ring shaped groove provided on an inner circumference of the second guide portion 20*b* and is positioned axially above the ends (inlet side) of the second injection bores 24 that are opened thereto. The collection groove 38 may be provided on an outer circumference of the second guide shaft 28.

The collection passage 39 extends axially upward from the collection groove 38 to an upper end of the nozzle body 3 and communicates with a leakage passage (not shown) provided in the injector body 5. The leakage passage is connected via a return pipe (not shown) to the fuel tank (low pressure source).

With the construction mentioned above, the collection groove 38 can collect high pressure fuel entering the sliding clearance between the second guide shaft 28 and the second guide portion 20*b* from an axial upper end side of the second guide shaft 28 before reaching the second injection bores 24, which results in reducing fuel leakage from the second injection bores 24 at the valve closing time.

The fuel collected in the collection groove 38 is returned to the fuel tank via the collection passage 39, the leakage passage and the return pipe. Further, high pressure fuel flowed into the clearance between the second guide shaft 28 and the second guide portion 20*b* serves to promote smooth slide of the second guide shaft 28 on the second guide portion 20*b*.

(Fifth Embodiment)

Figure 7:
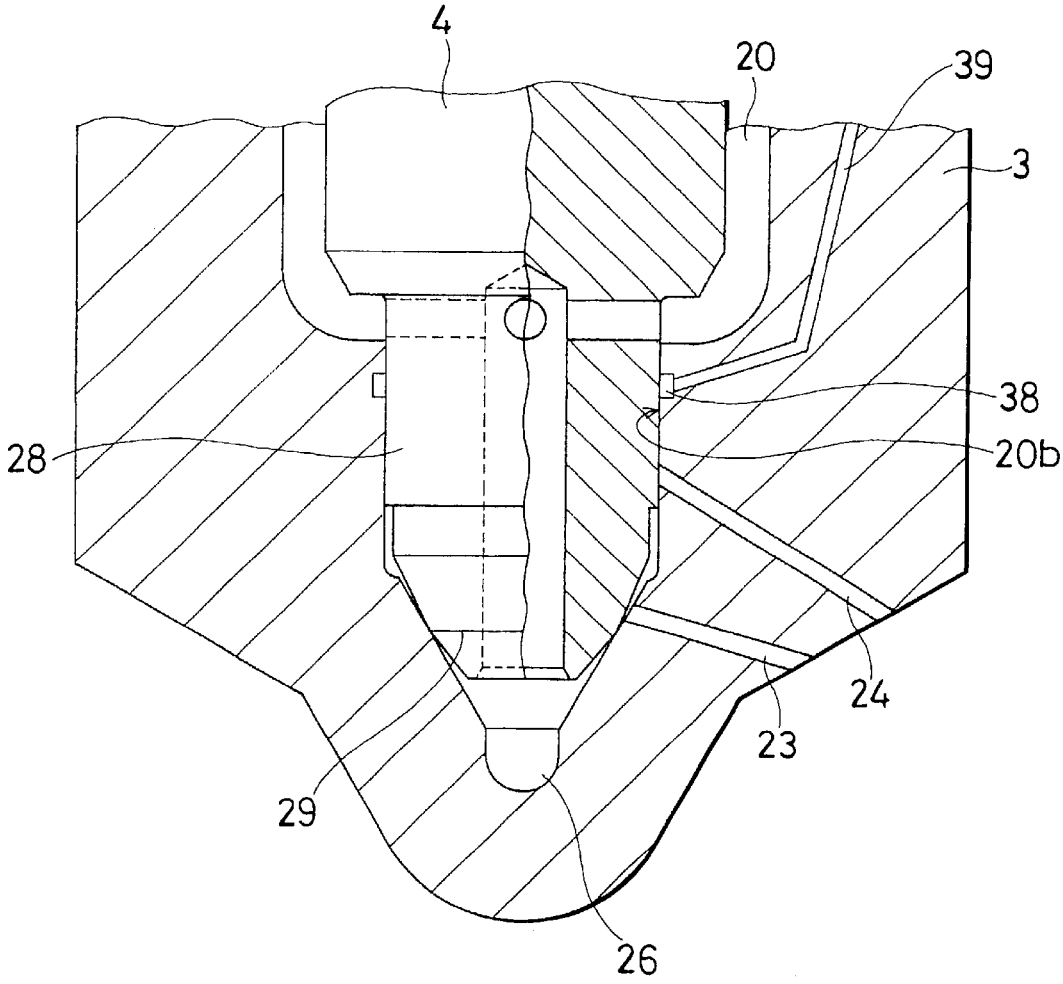
FIG. 7 is a partly enlarged cross sectional view of a fuel injection nozzle according to a fifth embodiment.

FIG. 7 shows an enlarged cross sectional view of an end portion of a nozzle according to a fifth embodiment.

In addition to the construction of the nozzle 1 according to the second embodiment, a nozzle 1 according to the fifth embodiment has fuel collection means.

Similarly to the fourth embodiment, the fuel collection means are composed of a ring shaped collection groove 38 provided in the inner circumference of the second guide portion 20*b* or the outer circumference of the second guide shaft 28 and a collection passage 39 communicating with the collection groove 38.

The fuel collection means according to the fifth embodiment has the same advantage as the fourth embodiment.

(Sixth Embodiment)

Figure 8:
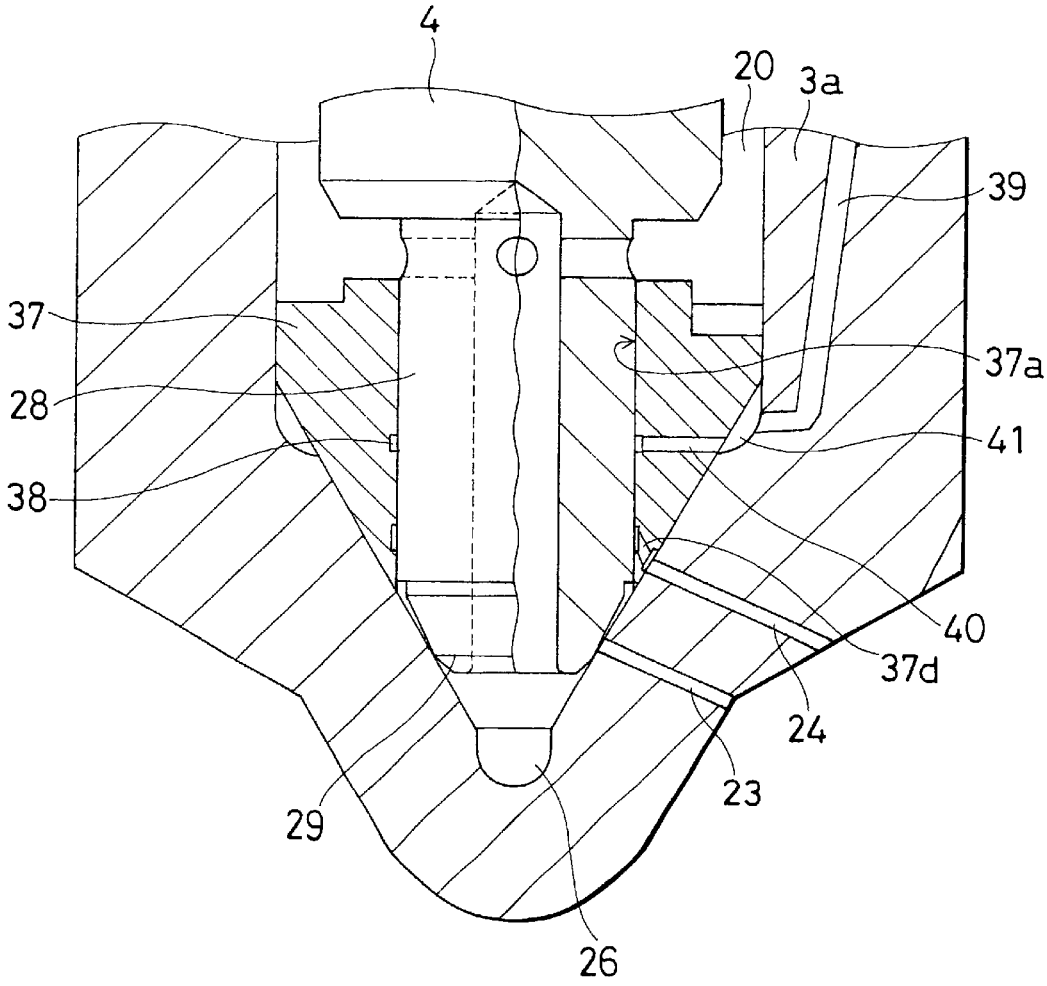
FIG. 8 is a partly enlarged cross sectional view of a fuel injection nozzle according to a sixth embodiment.
Figure 9:
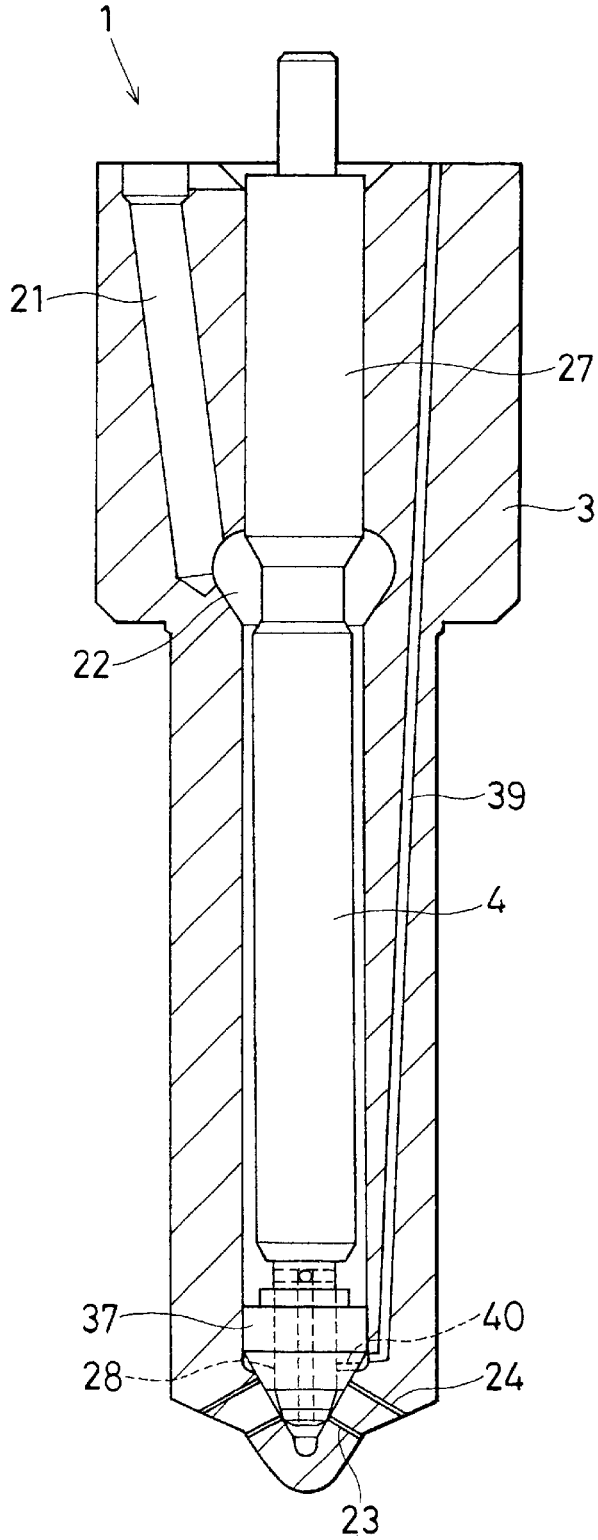
FIG. 9 is a cross sectional entire view of the fuel injection nozzle according to the sixth embodiment.

FIG. 8 shows an enlarged cross sectional view of an end portion of a nozzle according to a fifth embodiment. FIG. 9 shows a cross sectional entire view of the nozzle of FIG. 8.

In addition to the construction of the nozzle 1 according to the third embodiment, a nozzle 1 according to the sixth embodiment has fuel collection means, as shown in FIG. 8. The fuel collection means are composed of a collection groove 38 and a collection hole 40 both provided in the guide member 37 and a collection passage 39 provided in the nozzle body 3*a*.

The collection groove 38 is a ring shaped groove provided on an inner circumference of the second guide portion 37*a* and is positioned axially above the end (inlet side) of the communication hole 37*d*. The collection groove 38 may be provided on an outer circumference of the second guide shaft 28.

The collection hole 40 communicating with the collection groove 38 penetrates the guide member 37 so as to reach the outer circumference thereof and to open to a space 41 provided at a bottom of the guide hole 20.

As shown in FIG. 9, the collection passage 39 extends in an up and down direction along the guide hole 20 inside the nozzle body 3. An end of the collection passage 39 communicates via the space 41 with the collection hole 40 and the other end thereof is opened to the axial upper end of the nozzle body 3*a*.

With the construction mentioned above, the collection groove 38 can collect high pressure fuel entering the sliding clearance between the second guide shaft 28 and the second guide portion 37*a* from an axial upper end side of the second guide shaft 28 before reaching the second injection bores 24, which results in reducing fuel leakage from the second injection bores 24 at the valve closing time. The fuel collected in the collection groove 38 is returned to the fuel tank via the collection hole 40, the space 41, the collection passage 39, the leakage passage and the return pipe. Further, high pressure fuel flowed into the clearance between the second guide shaft 28 and the second guide portion 37*a* serves to promote smooth slide of the second guide shaft 28 on the second guide portion 37*a*.

(Seventh Embodiment)

Figure 10:
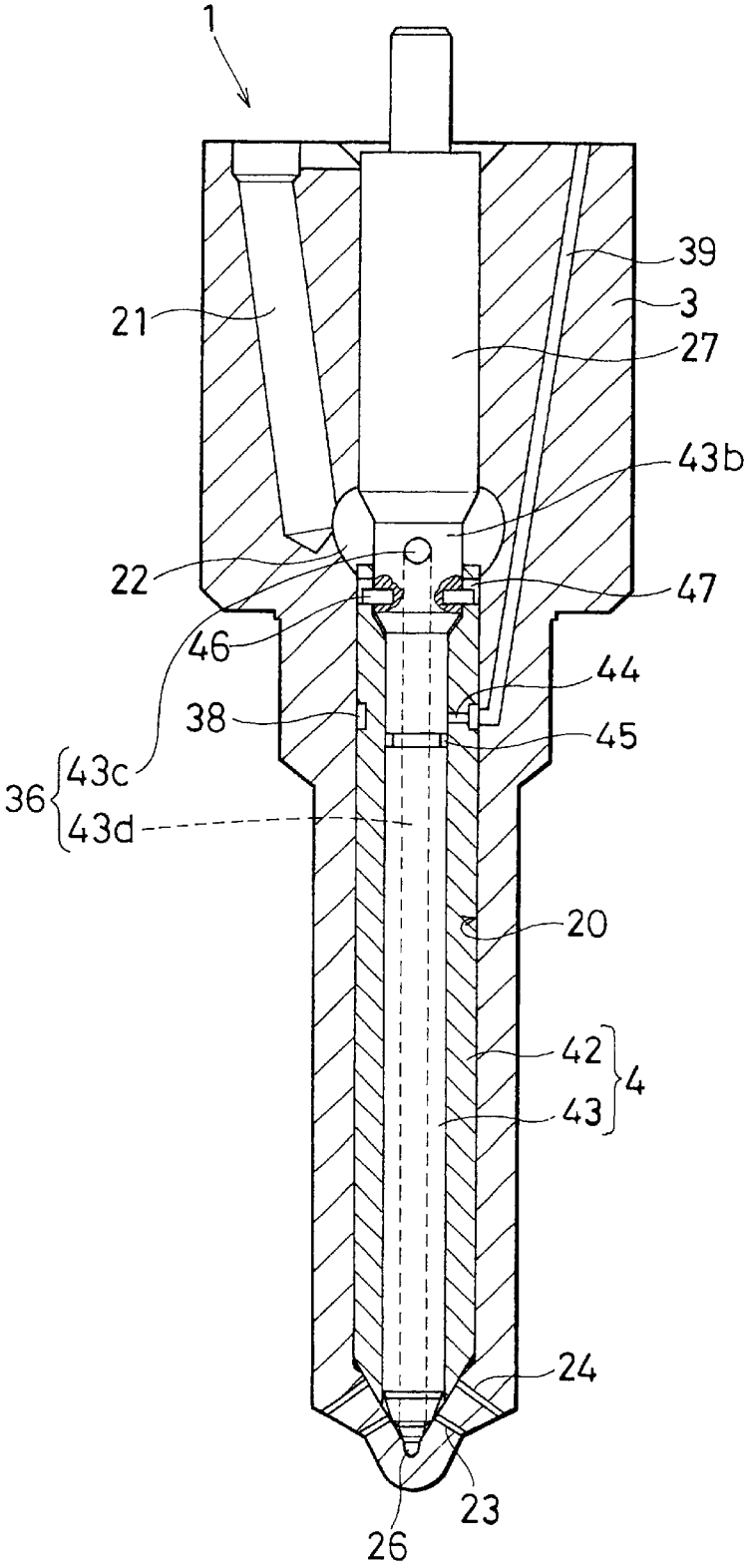
FIG. 10 is a cross sectional entire view of a fuel injection nozzle according to a seventh embodiment.
Figure 11:
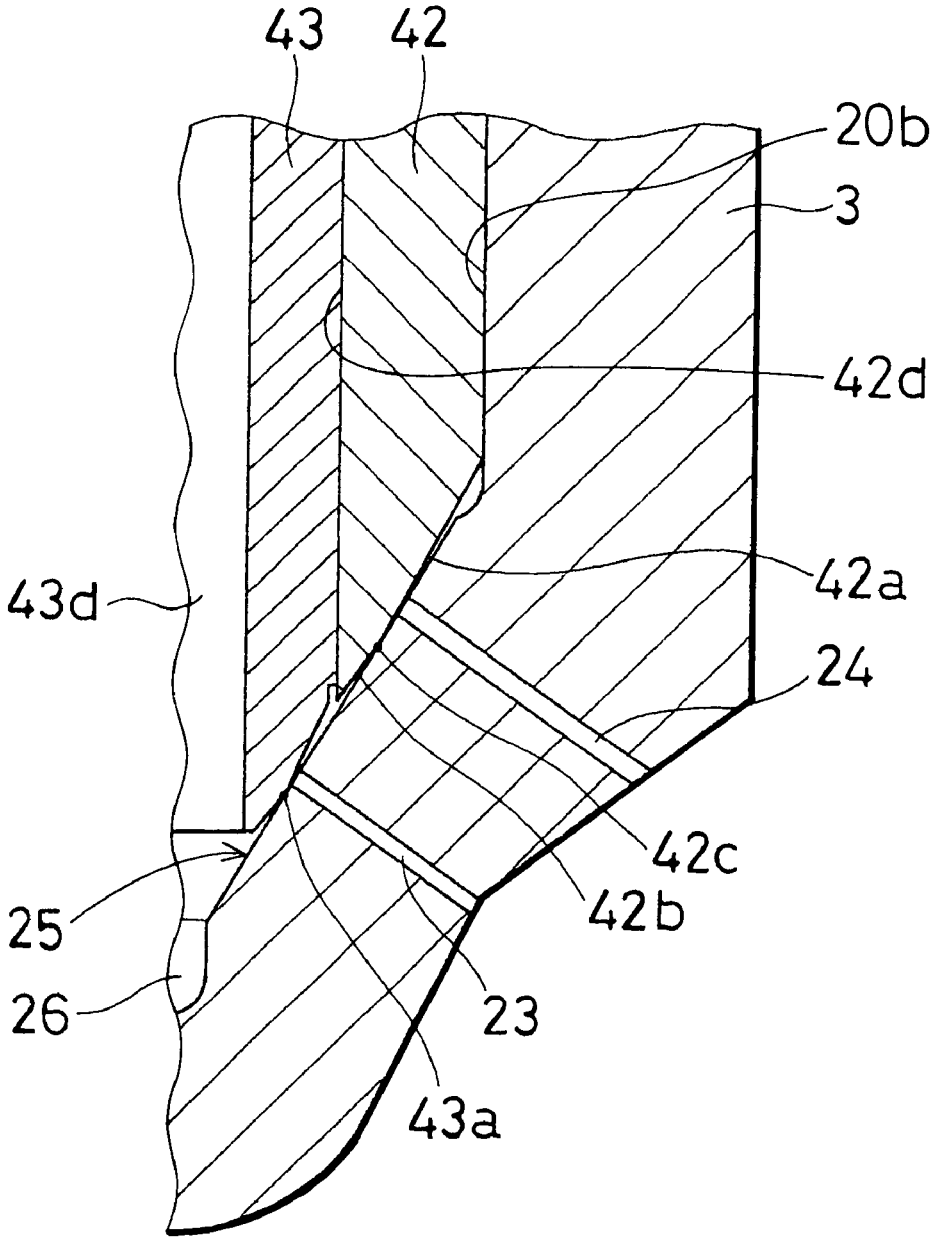
FIG. 11 is a partly enlarged semi-cross sectional view of the fuel injection nozzle of FIG. 10.

FIG. 10 shows a cross sectional entire view of a nozzle according to a seventh embodiment. FIG. 11 is a semi-cross sectional view of the nozzle of FIG. 10.

A nozzle 1 according to the seventh embodiment has a needle (needle member) 4 having dual construction for opening and closing injection bores (first and second injection bores 23 and 24).

The needle 4 is composed of a cylindrical outer needle 42 (second needle 42) for opening and closing the second injection bores 24 and an inner needle 43 (first needle 43) slidably fitted into a hollow (42*d*) of the second needle 42 for opening and closing the first injection bores 23.

The second needle 42, whose axial upper end is positioned at the fuel sump 22, is slidably fitted into the guide hole 20 (cylindrical inner circumferential wall 20*b*) of the nozzle body 3 and, upon receiving fuel pressure of the fuel sump 22, is operative to close the second fuel injection bores 24. The second needle 42 is provided at an axial lower end thereof with an upper side conical surface 42*a* and a lower side conical surface 42*b* whose conical angle is different from and larger than that of the upper side conical surface 42*a*. An annular boundary between the conical surfaces 42*a* and 42*b* constitutes a seat contact 42*c* (second seat contact 42*c*) coming in contact with the seat surface 25 of the nozzle body 3 at the valve closing time of the second injection bores 24 (refer to FIG. 11).

The first needle 43 is formed integrally with the first guide shaft 27 described in the first embodiment and provided at an axial end thereof with the seat contact (first seat contact 43*a*). The first seat contact 43*a* is constituted by an annular boundary between two conical surfaces whose conical angles are different, similarly to the second needle 42.

The first needle 43 has a fuel passage 36 through which high pressure fuel is supplied from the fuel sump 22 to the seat surface 25. The fuel passage 36 is composed of a lateral hole 43*c* radially extending in a middle diameter portion 43*b* of the first needle 43 at a position axially above an upper end of the second needle 42 and a vertical hole 43*d* whose one end is opened to the lateral hole 43*c*, which axially extends through a center of the first needle 43 and whose another end is opened to a lower end of the first needle axially below the circular seat contact 43*a*.

Further, the nozzle 1 according to the seventh embodiment has fuel collection means for collecting fuel flowed from the fuel sump to a sliding clearance between the guide hole 20 and the second needle 42 and to a sliding clearance between the first and second needles 43 and 42.

As shown in FIG. 10, the fuel collection means are composed of a collection groove 38 and a collection hole 44 both formed in the second needle 42, a ring shaped collection groove 45 formed in the first needle 43 and a collection passage 39 formed in the nozzle body 3.

The collection groove 38 of the second needle 42 is provided at a relatively upper part of the second needle 42 and formed in shape of a ring along an outer circumference of the second needle 42.

The collection hole 44 is a through-hole which radially extends in the second needle 42, whose one end communicates with the collection groove 38 and whose another end is opened to an inner circumference of the second needle 42.

The collection groove 45 of the first needle 43 is a ring groove formed on and along the outer circumference of the first needle at a position where the collection groove 45 communicates with the collection hole 44 when the first needle shows a first lift to open the first injection bores 23.

An end of the collection passage 39 is opened to the inner circumference of the guide hole 20 and communicates with the collection groove 38 of the second needle 42. Another end of the collection passage 39 is opened to the axial upper end of the nozzle body 3 and communicates with a leakage passage (not shown). The collection passage 39 communicates with the collection groove 38 only when the second needle 42 closes the second injection bores 24 (when the second seat contact 42c is seated on the seat surface 25) and the communication between the collection passage 39 and the collection groove 38 is interrupted when the second needle 42 shows a lift to open the second injection bores 24, that is, when the first needle 43 shows a second lift.

The leakage passage is formed in the injector body 5 and connected via a return pipe (not shown) to the fuel tank.

According to the fuel collection means mentioned above, high pressure fuel flowed from the fuel sump 22 to a sliding clearance between the guide hole 20 and the second needle 42 is collected in the collection groove 38 of the second needle 42 and returned to the fuel tank via the collection passage 39, the leakage passage and the return pipe.

High pressure fuel flowed from the fuel sump 22 to a sliding clearance between the first and second needles 43 and 42 is collected in the collection groove 45 of the first needle 43 and returned to the fuel tank via the collection hole 44, the collection groove 38, the collection passage 39, the leakage passage and the return pipe when the collection groove 45 communicates with the collection hole 44 at the first lift time of the first needle 43.

According to the needle 4 having the dual construction, a pin 46 press fitted into the middle diameter portion 43*b* of the first needle 43 is coupled and co-works with a lift inducement hole 47 formed at an upper part of the second needle 42 in such a manner that, after the first needle 43 lifts (first lift) for opening the first injection bores 23, the second needle 42 lifts together with the first needle 43 (second lift) for opening the second injection bores 24.

The pin 46 is coupled with the lift inducement hole 47 with a slight clearance between the pin 46 and a lower end of the lift inducement hole 47 when the first and second needles 43 and 42 do not lift and are in valve closing states so that the first needle 43 may close the first injection bore 23 without fail and with a slight clearance between the pin 46 and an upper end of the lift inducement hole 47 when the first needle 43 is in valve opening state and the second needle 42 is in valve closing state (first lift time) so that the second needle 42 may close the second injection bores 24 without fail. The pin 46 and the lift inducement hole 47 constitute lift force transmitting means.

Next, an operation of the nozzle 1 according to the seventh embodiment is described.

The lift control of the needle 4 is performed by changing a value of current applied to the coil 16 (refer to FIG. 2) of the electromagnetic actuator, similarly to the first embodiment. That is, at the first lift time, a first value of current is applied to the coil 16 so that the first needle 43 moves upward by the first lift amount (refer to the first embodiment) and, then, rests. At this time, the pin 46 press fitted to the middle diameter portion 43*b* of the first needle 43 moves to a position just before contacting the upper end of the lift inducement hole 47 formed in the second needle 42. Consequently, the first seat contact 43*a* leaves the seat surface 25 so that only the first injection bores 23 are opened for injecting fuel.

At the second lift time, a second value of current is applied to the coil 16 so that the first needle 43 moves upward up to the maximum lift amount (refer to the first embodiment). At this time, the pin 46 press fitted to the middle diameter portion 43*b* of the first needle 43 comes in contact with the upper end of the lift inducement hole 47 formed in the second needle 42 and pushes upward the second needle 42 so that the second needle 42 lifts together with the first needle 43. Consequently, the second seat contact 42*c* leaves the seat surface to open the second injection bores 24 so that fuel is injected not only from the first injection bores 23 but also from the second injection bores 24.

Then, when the current supply to the coil 16 stops, the first needle 43 is pushed in a valve closing direction by the biasing forces of the first and second springs 19 and 14 (refer to FIG. 2). On a way of the movement of the first needle 43 in a valve closing direction, the second needle 42 is pushed downward together with the first needle 43 since the pin 46 presses the lower end of the lift inducement hole 47. As a result, the first seat contact of the first needle 43 is seated on the seat surface 25 to close the first injection bores 23 so that fuel supply to the lower side of the conical surfaces 42*a* and 42*b* of the second needle 42 is blocked. Subsequently, the second needle 42 is further pushed downward by fuel pressure of the fuel sump 22 so that fuel on the lower side of the conical surfaces 42*a* and 42*b* is injected under high pressure from the fuel injection bores 24. When the second contact 42*c* is seated on the seat surface 25, the second injection bores 24 are closed.

In the nozzle according to the seventh embodiment, the first needle 43 for opening and closing the first injection bores 23 is held by the second needle 42 for opening and closing the second injection bores 24 and the second needle 42 is slidably fitted to the guide hole 20 of the nozzle body 3. With this construction, both first and second injection bores 23 and 24 can be opened to the seat surface 25 of the nozzle body 3 so that it is not necessary to provide the injection bores in the sack chamber 26 and to precisely form the sack chamber 26.

As the inner diameter of the guide hole 20 for slidably holding the second needle 42 is larger than the seat diameter (a diameter of annular contact between the second seat contact 42*c* and the seat surface 25), manufacturing work of the guide hole is relatively easy.

Further, since the second needle 42 is moved by the first needle 43 and the fuel pressure of the fuel sump 22, two step injection bore opening and closing control is performed without providing additional means such as springs.

Furthermore, in the nozzle 1 of the present embodiment, since the first and injection bores 23 and 24 are opened and closed by the first and second needles 43 and 42, respectively, fuel flowing from the fuel sump and entering the sliding clearance between the first and second needles 43 and 42 does not leak from the second fuel injection bores 24 at a valve closing time of the second injection bores 24.

Moreover, as the second needle 42 has a length to an extent that the axial end thereof reaches the fuel sump 22, the collection groove 38 is positioned at a relatively upper part of the second needle 42 and the collection groove 45 is also positioned at an upper part of the first needle 43. As a result, fuel entering the sliding clearance between the first and second needles 43 and 42 and the sliding clearance between the guide hole 20 and the second needle 42 from the fuel sump 22 is less leaked from the first and second injection bores 23 and 24.

What is claimed is:

1. A fuel injection nozzle for injecting high pressure fuel comprising:

a nozzle body member provided inside with a guide hole having a conical inner circumferential wall in a vicinity of an end thereof and a cylindrical inner circumferential wall axially above the conical inner circumferential wall, with at least a first injection bore whose one end is opened to the conical inner circumferential wall and whose another end is opened to outside, and on an axially above side of the first injection bore with at least a second injection bore whose one end is opened to one of the conical and cylindrical circumferential walls and whose another end being opened to outside; and a needle member inserted into the guide hole, the needle member being provided in a vicinity of an end thereof with a circular seat contact coming in contact with the conical inner circumferential wall, on an axially above side of the seat contact with a guide shaft whose outer diameter is larger than that of the circular seat contact and which is slidably fitted to the cylindrical circumferential wall, and with a fuel passage extending inside the guide shaft for introducing fuel to the first and second injection bores, wherein, when the needle member does not lift, the circular seat contact is in contact with the conical inner circumferential wall and the fuel passage does not communicate with both the first and second injection bores, when the needle member shows a first lift, the circular seat contact moves in a direction of leaving the conical inner circumferential wall and the fuel passage communicates with the first injection bore through a clearance between the circular seat contact and the conical inner circumferential wall but the guide shaft interrupts communication between the fuel passage and the second injection bore, and, when the needle member shows a second lift, the circular seat contact further moves in a direction of leaving the conical inner circumferential wall and, in addition to the communication between the fuel passage and the first injection bore, the guide shaft allows the communication between the fuel passage and second injection bore.

2. A fuel injection nozzle according to claim 1, wherein the needle member is provided axially above the guide shaft with an upper small diameter portion and axially below the guide shaft with a lower small diameter portion and the fuel passage is at least a through-hole axially penetrating from an upper end of the guide shaft radially outside the upper small diameter portion to a lower end thereof radially outside the lower small diameter portion and axially above the circular seat contact and, further, wherein the one end of the first injection bore is arranged axially below a position where the circular seat contact comes in contact with the conical inner circumferential wall, and outer circumference of the guide shaft serves, when the needle member does not lift or shows the first lift, to close the one end of the second injection bore and, when the needle member shows the second lift, to open the one end of the second injection bore.

3. A fuel injection nozzle according to claim 2, wherein the guide shaft is provided at the lower end thereof radially outside the lower small diameter portion with a guide shaft ring groove to which the through-hole is opened so that the lower end circumference of the guide shaft radially outside the guide shaft ring groove constitutes a thin thickness wall expanding radially outward when the needle member does not lift or shows the first lift so that the guide shaft fluid-tightly closes the one end of the second injection bore and suppresses fuel leakage from the second injection bore.

4. A fuel injection nozzle according to claim 1, wherein the fuel passage comprises a lateral hole radially extending in the guide shaft at a position axially above an upper end of the cylindrical inner circumferential wall and a vertical hole whose one end is opened to the lateral hole, which axially extends through a center of the guide shaft and whose another end is opened to a lower end of the needle member axially below the circular seat contact and, further, wherein the end of the first injection bore is arranged axially above a position where the circular seat contact comes in contact with the conical inner circumferential wall, and outer circumference of the guide shaft serves, when the needle member does not lift or shows the first lift, to close the one end of the second injection bore and, when the needle member shows the second lift, to open the one end of the second injection bore.

5. A fuel injection nozzle according to claim 4, wherein the nozzle body member comprises a nozzle body and a ring shaped guide member whose outer circumference is press fitted into an inner circumference of the nozzle body, the ring shaped guide member having the cylindrical inner circumferential wall from which the second injection bore extends via both insides of the ring shaped guide member and the nozzle body to outside of the nozzle body.

6. A fuel injection nozzle according to claim 5, wherein both of the nozzle body and the ring shaped guide member have positioning portions with reference to which relative circumferential position between the nozzle body and the ring shaped guide member is defined.

7. A fuel injection nozzle according to claim 5, wherein at least one of the outer circumference of the guide shaft and the cylindrical inner circumferential wall of the ring shaped guide member is provided axially above the second injection bore with a ring shaped collection groove and each of the ring shaped guide member and the nozzle body is provided with a collection passage, one end of the collection passage of the ring shaped guide member communicating with the collection passage and another end thereof communicating with an end of the collection passage of the nozzle body and another end of the collection groove of the nozzle body communicating with a low pressure source, whereby the high pressure fuel entering a clearance between the outer circumference of the guide shaft and the cylindrical inner circumferential wall of the ring shaped guide member is returned through the collection groove and the collection passages of the ring shaped guide member and the nozzle body to the low pressure source.

8. A fuel injection nozzle according to claim 1, wherein the needle member comprises an outer needle provided inside with a cylindrical through-hole and in a vicinity of an end thereof with another circular seat contact coming in contact with the conical inner circumferential wall, and an inner needle slidably fitted to the cylindrical through-hole, the outer needle constituting the guide shaft and the inner needle having the circular seat contact and the fuel passage, and, further, wherein, when the needle member does not lift, both the circular and another circular seat contacts are in contact with the conical inner circumferential wall, when the needle member shows the first lift, only the inner needle moves and the outer needle does not move, and, when the needle member shows the second lift, the outer needle moves together with the inner needle.

9. A fuel injection nozzle according to claim 8, wherein the fuel passage comprises a lateral hole radially extending in the inner needle at a position axially above an upper end of the outer needle and a vertical hole whose one end is opened to the lateral hole, which axially extends through a center of the inner needle and whose another end is opened to a lower end of the inner needle axially below the circular seat contact, and, further, wherein the one end of the first injection bore is arranged axially above a position where the circular seat contact comes in contact with the conical inner circumferential wall and axially below a position where the another circular seat contact comes in contact with the conical inner circumferential wall, the one end of the second injection bore is arranged at the conical inner circumferential wall axially above the position where the another circular seat contact comes in contact with the conical inner circumferential wall, and, when the needle member shows the first lift, the fuel passage communicates only with the first injection bore through the clearance between the circular seat contact and the conical inner circumferential wall and, when the needle member shows the second lift, the fuel passage communicates with the second injection bore through a clearance between the another circular seat contact and the conical inner circumferential wall.

10. A fuel injection nozzle according to claim 8, wherein the inner and outer needles are provided with lift force transmitting means through which a lift force is transmitted from the inner needle to the outer needle at least when the needle member shows the second lift.

11. A fuel injection nozzle according to claim 8, wherein at least one of the outer circumference of the outer needle and the cylindrical inner circumferential wall is provided axially above the second injection bore with a ring shaped collection groove, the nozzle body member is provided with a collection passage whose one end communicates with the collection groove and whose another end communicates with a low pressure source, the outer needle is provided with a radial through-hole whose one end communicates with the ring shaped collection groove when the needle member does not lift and the inner needle is provided on outer circumference thereof with a ring groove coming in communication with another end of the radial through hole when the needle member shows the first lift, whereby the high pressure fuel entering a clearance between the outer circumference of the outer needle and the cylindrical inner circumferential wall is returned through the collection groove and the collection passage to the low pressure source and the high pressure fuel entering a clearance between an outer circumference of the inner needle and an inner circumference of the outer needle is returned through the ring groove, the radial through-hole, the collection groove and the collection passage to the low pressure source.

12. A fuel injection nozzle according to claim 1, wherein at least one of the outer circumference of the guide shaft and the cylindrical inner circumferential wall is provided axially above the second injection bore with a ring shaped collection groove and the nozzle body member is provided with a collection passage whose one end communicates with the collection groove and whose another end communicates with a low pressure source, whereby the high pressure fuel entering a clearance between the outer circumference of the guide shaft and the cylindrical inner circumferential wall is returned through the collection groove and the collection passage to the low pressure source.

* * * * *